US009739162B2

(12) United States Patent
Bottome et al.

(10) Patent No.: US 9,739,162 B2
(45) Date of Patent: Aug. 22, 2017

(54) ANNULUS FILLER

(71) Applicant: ROLLS-ROYCE PLC, London (GB)

(72) Inventors: Kristofer John Bottome, Nottingham (GB); Paul Mason, Derby (GB); James Andrew Lee, Ryde (GB); Ewan Fergus Thompson, Derby (GB)

(73) Assignee: ROLLS-ROYCE plc, London (GB)

( * ) Notice: Subject to any disclaimer, the term of this patent is extended or adjusted under 35 U.S.C. 154(b) by 721 days.

(21) Appl. No.: 14/457,845

(22) Filed: Aug. 12, 2014

(65) Prior Publication Data

US 2015/0300194 A1 Oct. 22, 2015

(30) Foreign Application Priority Data

Aug. 14, 2013 (GB) ..... 1314541.2

(51) Int. Cl.

| | |
|---|---|
| ***F01D 11/08*** | (2006.01) |
| ***F01D 11/00*** | (2006.01) |
| ***F01D 5/02*** | (2006.01) |

(52) U.S. Cl.

CPC ..... *F01D 11/08* (2013.01); *F01D 5/02* (2013.01); *F01D 11/008* (2013.01); *F05D 2220/32* (2013.01); *F05D 2220/36* (2013.01); *F05D 2230/60* (2013.01); *F05D 2240/55* (2013.01); *F05D 2300/603* (2013.01); *F05D 2300/6034* (2013.01)

(58) Field of Classification Search

CPC ..... F01D 11/006; F01D 11/008

See application file for complete search history.

(56) References Cited

U.S. PATENT DOCUMENTS 8,066,479 B2 * 11/2011 El-Aini ..... F01D 5/26 416/1
8,827,651 B2 * 9/2014 Bottome ..... F01D 11/008 416/193 R (Continued)

FOREIGN PATENT DOCUMENTS

| | | |
|---|---|---|
| EP | 2 090 749 A2 | 8/2009 |
| EP | 2 503 102 A2 | 9/2012 |

OTHER PUBLICATIONS

Oct. 29, 2014 Search Report issued in European Application No. 14180627.

(Continued)

*Primary Examiner* — Woody Lee, Jr.
(74) *Attorney, Agent, or Firm* — Oliff PLC

(57) ABSTRACT

An annulus filler is provided for mounting to a rotor disc of a gas turbine engine and bridging the gap between two adjacent blades attached to the rotor disc. The annulus filler is substantially entirely formed from a polymer matrix composite material. It has an outer lid which defines an airflow surface for air being drawn through the engine in an axial airflow direction, and a support structure which is connectable to the rotor disc to support the lid on the rotor disc. The support structure has two support walls extending from opposing lateral sides of the lid to an attachment strap for receiving a hook on the rotor disc, the attachment strap bridging the support walls. In use, under centrifugal loads, the opposing support walls resiliently deform to allow outward radial movement of the lid. Each support wall is thickened in a region neighboring the attachment strap.

25 Claims, 10 Drawing Sheets

(56) References Cited

U.S. PATENT DOCUMENTS

| | | | | |
|---|---|---|---|---|
| 9,366,185 | B2 * | 6/2016 | Salamon | F02C 7/20 |
| 9,399,922 | B2 * | 7/2016 | Lamboy | F01D 5/3007 |
| 2009/0208335 | A1 * | 8/2009 | Bottome | F01D 11/008 416/179 |
| 2010/0209253 | A1 * | 8/2010 | Menheere | F01D 5/3092 416/219 R |
| 2011/0146299 | A1 * | 6/2011 | Hoyland | F01D 11/006 60/797 |
| 2012/0244003 | A1 * | 9/2012 | Mason | F01D 11/008 416/219 R |

OTHER PUBLICATIONS

Search Report issued in British Patent Application No. 1314541.2 dated Mar. 13, 2014.

* cited by examiner

ANNULUS FILLER

The present invention relates to annulus fillers for bridging the gap between adjacent blades of a gas turbine engine stage.

Conventionally, a compressor rotor stage comprises a plurality of radially extending blades mounted on a disc. The blades are mounted on the disc by inserting a root portion of the blade in a complementary retention groove in the outer face of the disc periphery. To ensure a radially smooth inner surface for air to flow over as it passes through the stage, annulus fillers can be used to bridge the spaces between adjacent blades. Typically, a seal between the annulus fillers and the adjacent fan blades is provided by resilient strips bonded to the annulus fillers adjacent the fan blades.

Annulus fillers of this type are commonly used in the fan stage. The fillers may be manufactured from relatively lightweight materials and, in the event of damage, may be replaced independently of the blades. In particular, filler release may result from bird strike on the filler or from excessive blade movement. To reduce the risk of engine damage in the event of such release and to reduce weight, the filler can be formed of lightweight carbon fibre reinforced composite material.

Annulus fillers come in various shapes and sizes depending on the design and construction of the gas turbine engine into which they are inserted. However, generally, annulus fillers have an outer lid which defines an airflow surface for air being drawn through the engine, the lid having a leading edge and a trailing edge in an axial airflow direction, and a support arrangement which connects directly or indirectly to the rotor disc to support the lid thereon. For example, the support arrangement may comprise one or more of a pin formation (e.g. for attaching the front of the filler to the disc), a mounting ring formation (e.g. for attaching the rear of the filler to the disc), and a hook formation (e.g. for attaching the underside of the filler to the disc).

The support arrangements need to be sufficiently strong and resilient to resist the high centrifugal loads experienced by the filler in use. Additionally, the support arrangements must resist impact loads that can subject the filler to radial and/or circumferential movement.

However, the support arrangements often introduce stress concentrations in the arrangements themselves or in other parts of the annulus filler. In order to combat these stress concentrations and ensure adequate component life, annulus fillers are conventionally relatively large and heavy.

A first aspect of the invention provides an annulus filler for mounting to a rotor disc of a gas turbine engine and bridging the gap between two adjacent blades attached to the rotor disc, the annulus filler being substantially entirely formed from a polymer matrix composite material, and the annulus filler having:

- an outer lid which defines an airflow surface for air being drawn through the engine in an axial airflow direction, and
- a support structure which is connectable to the rotor disc to support the lid on the rotor disc, the support structure having two support walls extending from opposing lateral sides of the lid to an attachment strap for receiving a hook on the rotor disc, the attachment strap bridging the support walls, and, in use under centrifugal loads, the support walls resiliently deforming to allow outward radial movement of the lid;
- wherein each support wall is thickened in a region neighbouring the attachment strap.

Advantageously, the lid and the support structure can combine to form an annular or box-like structure, with the thickening of the walls helping to reduce stress concentrations in the support structure. Such a box-like structure can be both stiff and lightweight, helping to resist tangential loads (e.g. during fan blade off). It can also be relatively easy to manufacture from polymer matrix composite material and thus reduces cost.

Typically, the receiving hook has laterally spaced side faces. Each support wall can then be arranged to pass around a respective side face such that, when the support structure is connected to the rotor disc, the attachment strap is substantially prevented from sliding tangentially relative to the hook. This can help the filler to resist tangential loads which may be experienced during fan blade off events.

Indeed, a second aspect of the invention provides an annulus filler for mounting to a rotor disc of a gas turbine engine and bridging the gap between two adjacent blades attached to the rotor disc, the annulus filler being substantially entirely formed from a polymer matrix composite material, and the annulus filler having:

- an outer lid which defines an airflow surface for air being drawn through the engine in an axial airflow direction, and
- a support structure which is connectable to the rotor disc to support the lid on the rotor disc, the support structure having two support walls extending from opposing lateral sides of the lid to an attachment strap for receiving a hook on the rotor disc, the attachment strap bridging the support walls;
- wherein the receiving hook has laterally spaced side faces and each support wall is arranged to pass around a respective side face such that, when the support structure is connected to the rotor disc, the attachment strap is substantially prevented from sliding tangentially relative to the hook. In use under centrifugal loads, the support walls may resiliently deform to allow outward radial movement of the lid.

A third aspect of the invention provides a stage for a gas turbine engine having:

- a rotor disc,
- a circumferential row of spaced apart blades attached to the rotor disc, and
- a plurality of annulus fillers according to the first or second aspect bridging the gaps between adjacent blades.

A fourth aspect of the invention provides a gas turbine engine having the stage of the third aspect.

Optional features of the invention will now be set out. These are applicable singly or in any combination with the first aspect of the invention, or with the third or fourth aspect as dependent on the first aspect.

The thickened region may end at a radial distance from the attachment strap which is at least 5% and/or is no more than 40% of the total radial distance from the attachment strap to the outer lid.

Each support wall may be at least 20% and/or at most 100% thicker in the thickened region than in regions of the support wall radially outside the thickened region.

At least in regions neighbouring the support walls, the attachment strap may be at least as thick as the thickened regions of the support walls. This can also help to reduce stress concentrations in the support structure.

The attachment strap may have a composite material first part which is integrally formed with the composite material of the support walls, and further may have a second part in the form of a pad which is carried by the first part and engages the hook of the rotor disc, the pad being formed from a different material to the composite material first part. The pad may be relatively compliant compared to the composite material first part.

The pad may be adhesively bonded to the composite material first part. This allows many different materials to be used to form the pad and avoids the manufacturing complexity of integrating the pad with the composite material first part during build-up of the composite material.

The pad may be a galvanic corrosion barrier to prevent or reduce galvanic corrosion between the composite material of the support structure and the rotor disc. Conveniently, the pad may have wings which extend along the support walls to provide some or all of the thickening in the thickened regions of the support walls. Thus the wings may protect the composite material of the support walls from contact with the fan disc hook as well as reducing stress concentrations in the support walls.

The composite material first part may bridge the support walls. Alternatively, the composite material first part may be formed by two composite material side portions, each integrally formed with the composite material of a respective one of the support walls, the pad bridging a gap between the side portions.

Further optional features of the invention will now be set out. These are applicable singly or in any combination with any aspect of the invention.

The support walls of the support structure may resiliently deform by flexing inwards towards each other to allow outward radial movement of the lid. This mode of deformation can help to reduce dangerous stress concentrations in the support structure.

The annulus filler may have a first engageable portion at the front end thereof, the first engageable portion being engageable with a complementary engageable portion of an adjacent part of the gas turbine engine to prevent circumferential movement of the front end of the annulus filler relative to the rotor disc. For example, the first engageable portion may be a pin, which fits into a receiving hole formed in a support ring attached to the rotor disc.

The outer lid of the annulus filler may have a second engageable portion at the trailing edge thereof, upon outward radial movement of the lid, the second engageable portion engaging with a sealing component, such as a fan rear seal, of the gas turbine engine to resist further outward radial movement.

The polymer matrix composite material may be a carbon fibre composite material. Other options, however, include glass fibre, and mixed carbon and glass fibre composite materials. The annulus filler may be for use with metallic or composite blades.

The filler may be for mounting to a fan disc and bridging the gap between two adjacent fan blades attached to the fan disc.

The support structure may support the rear or the front of the lid. Indeed, the annulus filler may have two or more support structures, for example a front support structure supporting the front of the lid and a rear support structure supporting the rear of the lid.

When the support structure is a rear support structure supporting the rear of the lid, each support wall of the support structure may have a concave rear edge which extends rearwardly and radially outwardly from the rear of the attachment strap towards a trailing edge of the lid, each rear edge having a first curved section proximal the attachment strap, a second curved section proximal the trailing edge and a substantially straight section therebetween. Advantageously the curved and straight sections reduce stress concentrations, while allowing the trailing edge of the outer lid to move radially outward under centrifugal loading and helping to reduce the mass of the support structure.

The first curved section may extend for at least 5% and/or at most 15%, of the total length of the rear edge. The second curved section may extend for at least 10% and/or at most 40%, of the total length of the rear edge. The first curved section may have a smaller radius of curvature than that of the second curved section. Each support wall of the rear support structure may have a concave front edge which extends forwardly and radially outwardly from the front of the attachment strap.

Embodiments of the invention will now be described by way of example with reference to the accompanying drawings in which.

Figure 9:
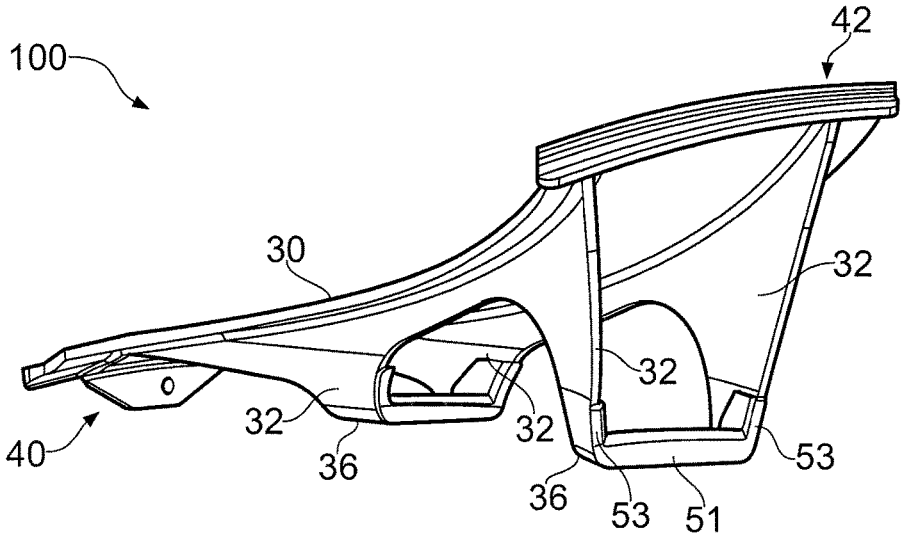
FIG. 9 shows a perspective view from the rear of another annulus filler.
Figure 12:
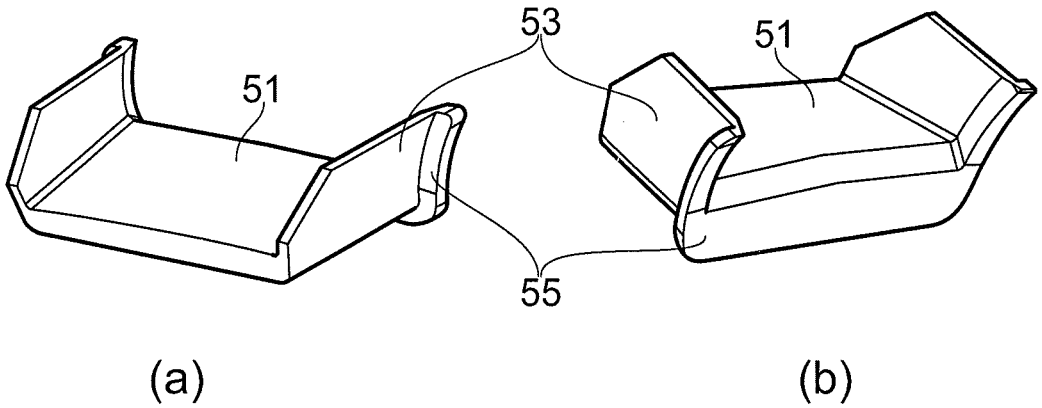
Figure 13:
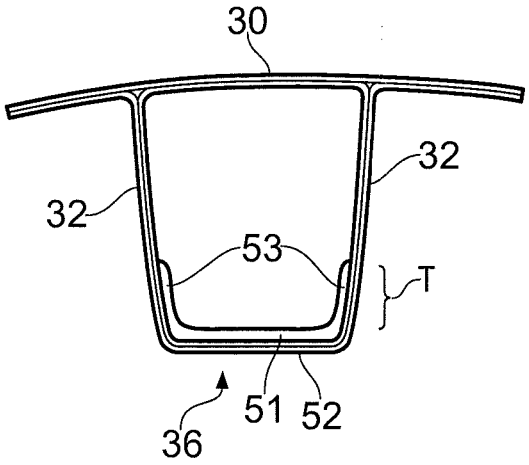
Figure 14:
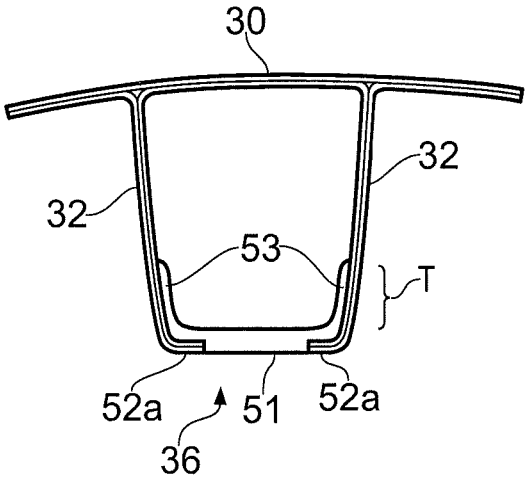
Figure 15:
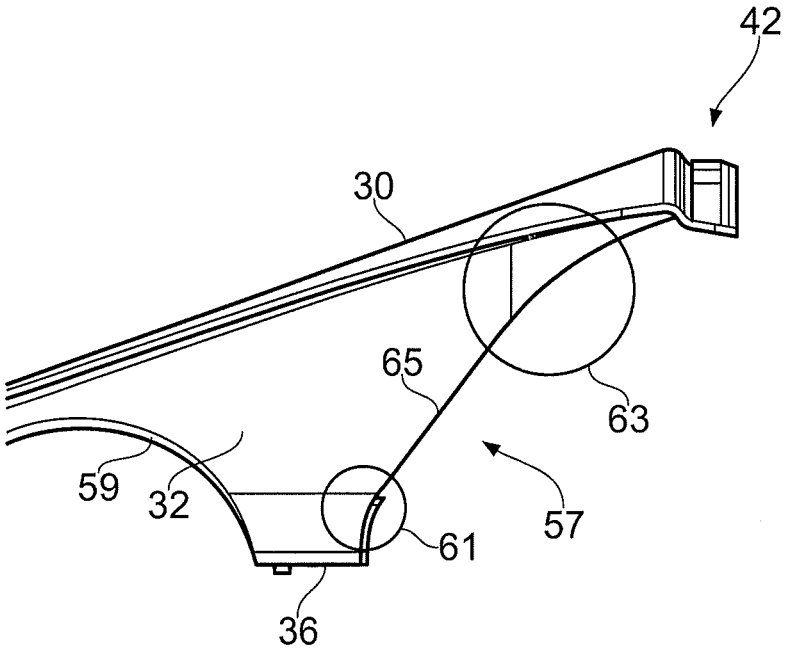

FIGS. 12 (*a*) and (*b*) show perspective views from the front and the rear respectively of a pad used with support structures of the annulus filler of FIG. 9;

FIG. 13 shows a schematic transverse cross-sectional representation of the rear support structure of the annulus filler of FIG. 9;

FIG. 14 shows a schematic transverse cross-sectional representation of a variant of the rear support structure of FIG. 13; and FIG. 15 shows an enlarged perspective view from the side of the rear of the annulus filler of FIG. 9.

Figure 1:
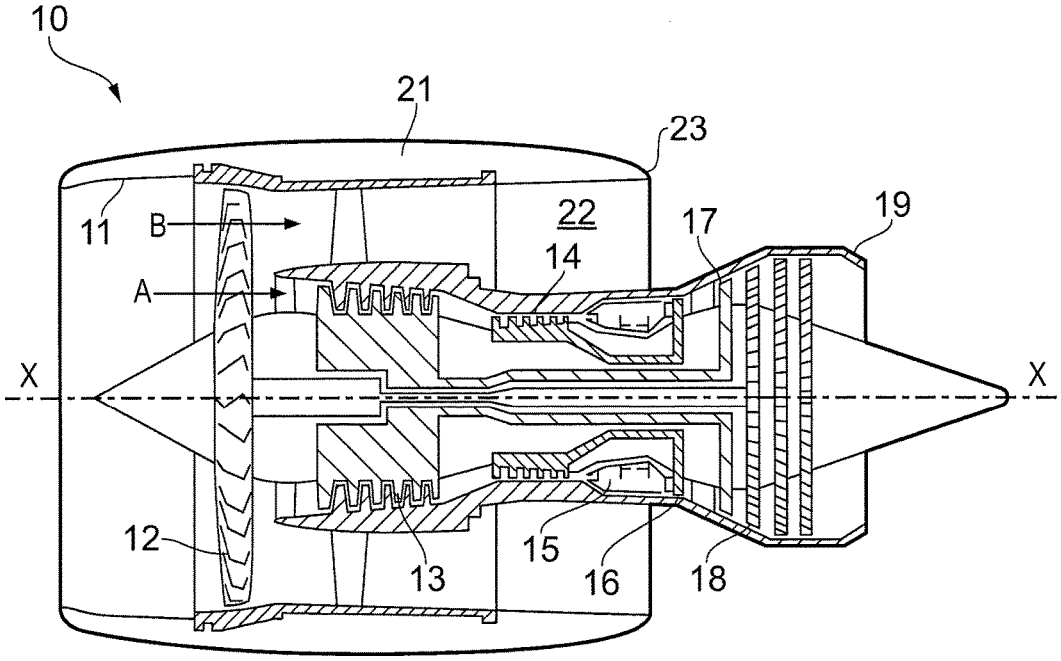
FIG. 1 shows a longitudinal cross-section through a ducted fan gas turbine engine.

With reference to FIG. 1, a three-shaft ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23. The invention can also be applied to other forms of gas turbine engine, such as two-shaft engines.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Annulus fillers may be used to bridge the spaces between adjacent blades, for example at the fan 12. This is to ensure a smooth radially inner surface for air to flow over as it passes through the fan 12.

Figure 2:
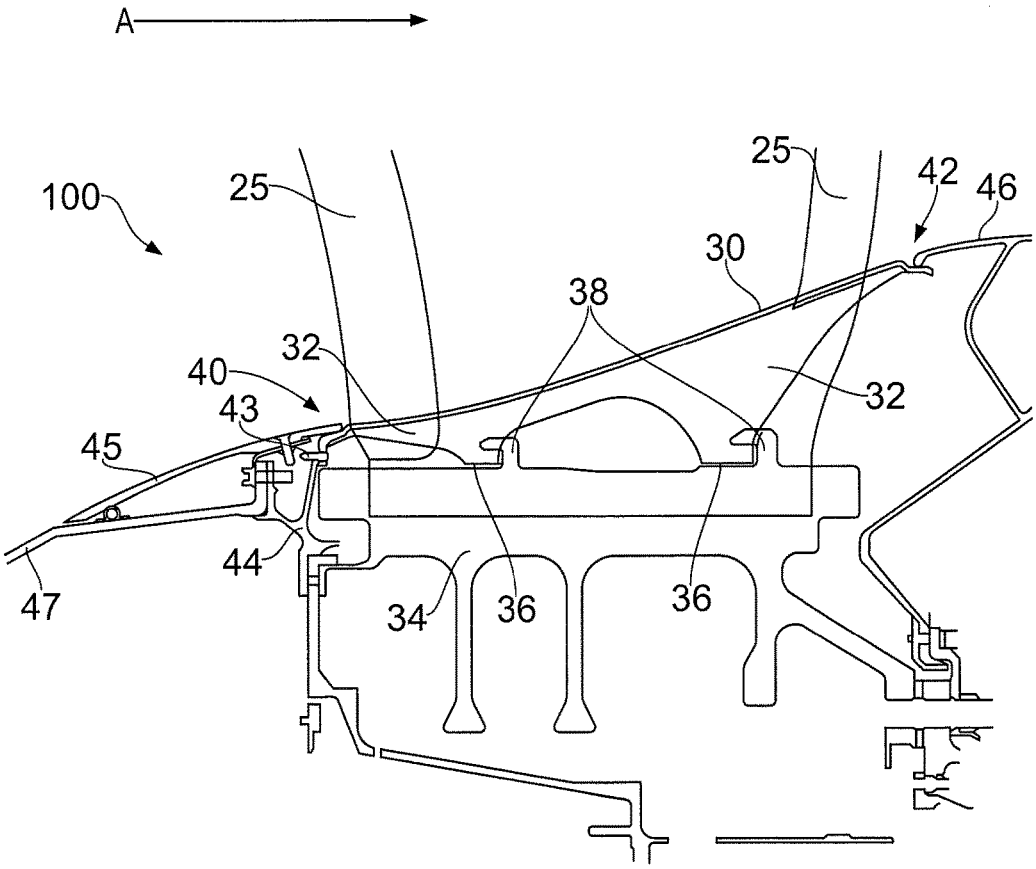
FIG. 2 shows a longitudinal cross-section of an annulus filler.
Figure 3:
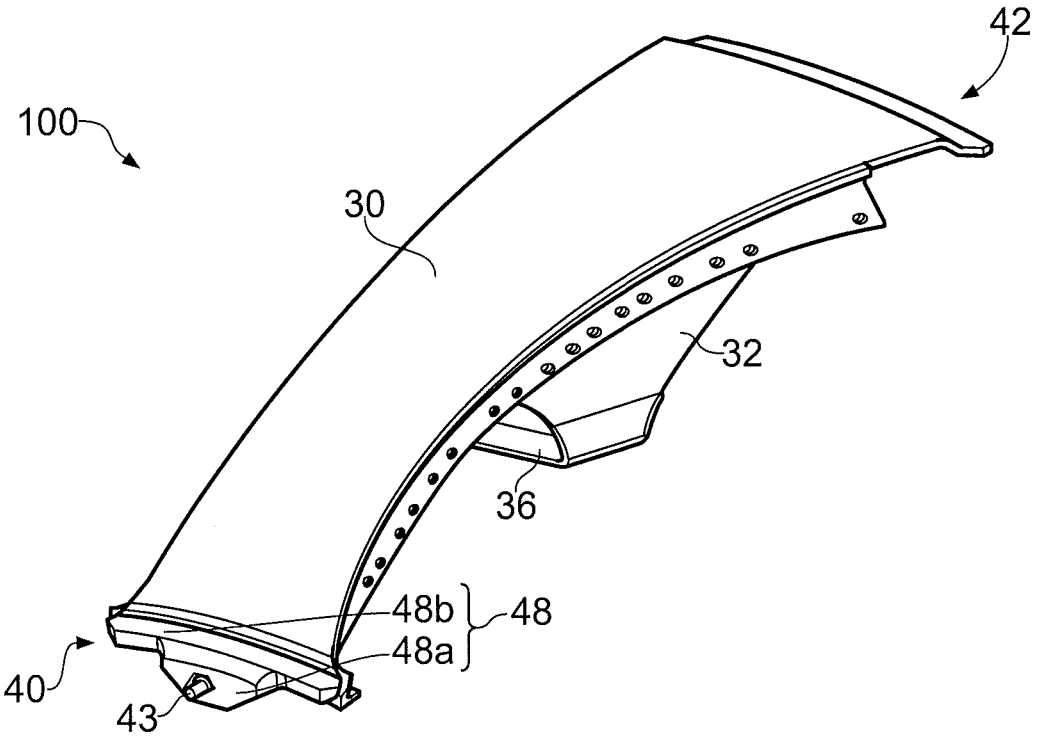
FIG. 3 shows a perspective view from the front of the annulus filler of FIG. 2.
Figure 4:
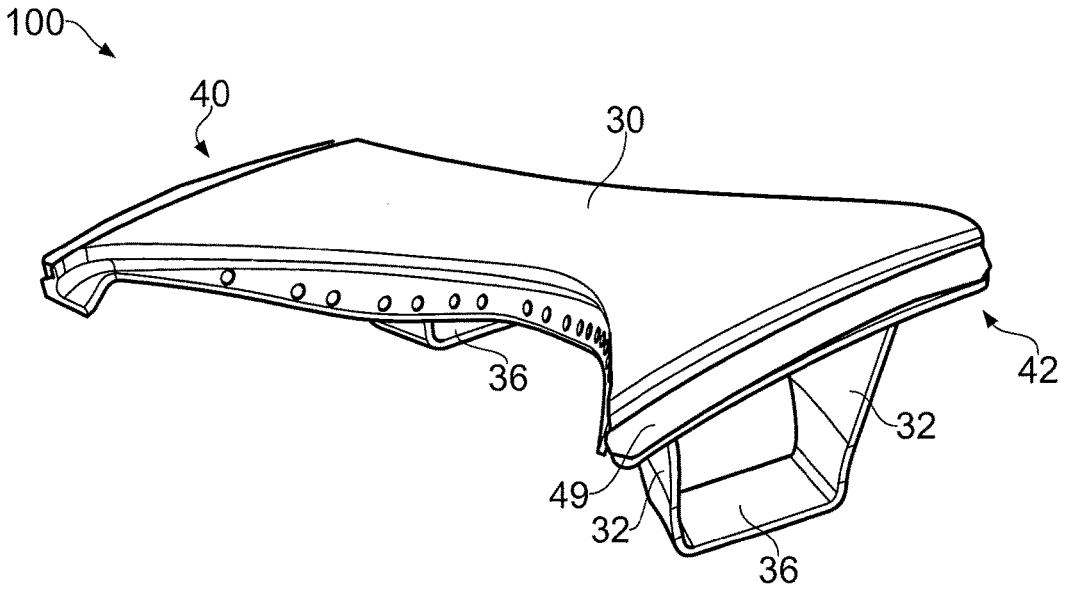
FIG. 4 shows a perspective view from the rear of the annulus filler of FIG. 2.

FIGS. 2 to 4 shows an annulus filler 100 which sits between two fan blades 25 and is formed from carbon fibre reinforced composite material. However, other polymer matrix composite material options can also be used for forming the filler. The fan blades 25 may be metallic or a composite material, for example carbon fibre reinforced composite material.

The filler 100 comprises an outer lid 30 which defines an airflow surface for air being drawn through the gas turbine engine 10 in direction A, and two axially spaced support structures which are connectable to complementary hooks 38 on a rotor disc 34 of the engine. These structures react the main centrifugal radial loads through the hooks when the rotor disc 34 spins. However, in alternative configurations, the filler 100 and the rotor disc 34 may only have one such support structure/hook, or may have more than two such support structures/hooks.

The front support structure supports the front of the filler at a front hook 38, and the rear support structure to support the rear of the filler at a rear hook 38. Each support structure comprises two support walls 32 extending from opposing lateral sides of the lid 30. Bridging the support walls is an attachment strap 36, which receives the hook 38 on the rotor disc 34.

Each support structure and the lid 30 form a stiff and lightweight box-like structure, which is able to spread and resist the loads on the filler 100. For example, the two opposing support walls 32 extending from opposing lateral sides of the lid 30 distribute loads and provide support either side of the hook 38 on the rotor disc 34 to resist the tangential loads typically experienced during fan blade off events. Further, the box-like structure advantageously promotes in-plane tension loading of its composite material under centrifugal loads. Conveniently, the box-like structure can be formed without internal features. The box-like structure, particularly if formed without internal features, is also relatively easy to manufacture, e.g. from an annular arrangement of continuous fibre reinforcement which can then be moulded and machined. The lid may be stitched or z-pinned to the rest of the filler. This can improve the through-thickness strength of the box-like structure, which may be beneficial for hail and birdstrike protection.

The support structures allow the filler 100 to be installed on the rotor disc 34 without a need for additional parts.

The annulus filler 100 further has a first engageable portion 40 at the leading edge of the lid 30 (shown in FIG. 3), and a second engageable portion 42 at the trailing edge of the lid (shown in FIG. 4).

The first engageable portion has an engageable surface **48*a* that abuts with a support ring 44 attached to the rotor disc 34, and a pin 43 which fits into a receiving hole formed in the support ring and prevents circumferential movement of the front end of the annulus filler relative to the rotor disc 34. The first engageable portion also has an engageable surface 48*b* that engages a makeup piece 45 forming an aerodynamic surface between the lid 30 and a spinner fairing 47**. Alternatively, the spinner fairing itself may be extended so as to engage with the annulus filler directly.

Figure 5:
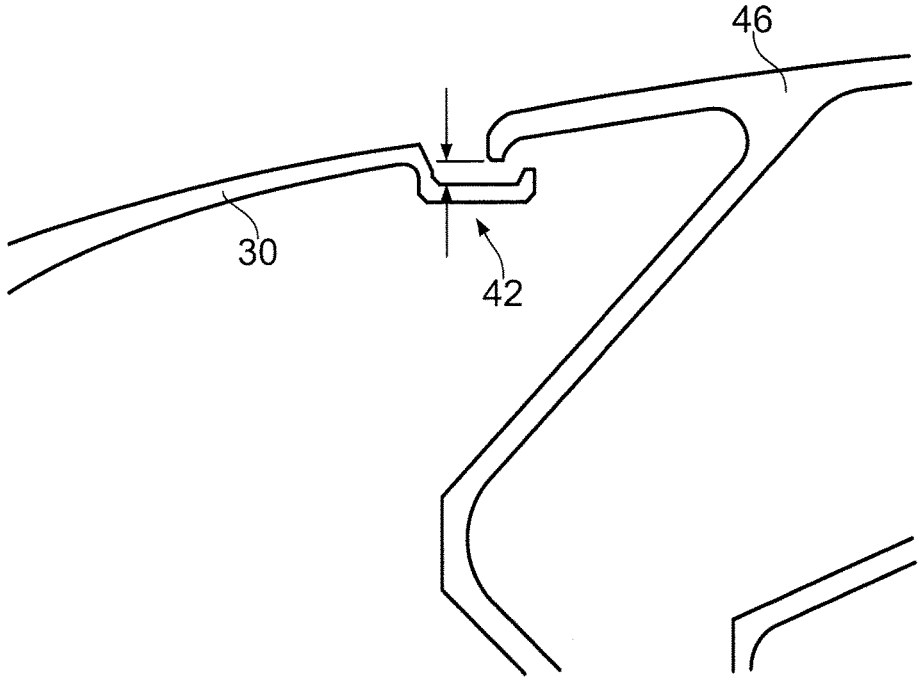
FIG. 5 shows an enlarged longitudinal cross-section of the trailing edge of the annulus filler of FIG. 2.

The second engageable portion engages, in use, with a fan rear seal 46 also attached to rotor disc 34. More particularly, as shown in FIG. 5, the second engageable portion 42 fits underneath the fan rear seal 46 and, when the engine is stationary, is spaced a distance radially inwardly therefrom. For example, a nominal cold build clearance may be in the range from 0.5-5.0 mm. In use, when the rotor disc 34 begins to spin, the second engageable portion 42 moves outwardly under centrifugal loading. Above a certain engine speed (e.g. about 800 rpm), depending on clearance, engine application and filler design, the second engageable portion contacts the fan rear seal 46, and begins to exert a force on the seal. The effect of this force is to change the unsupported length of the seal, as well as to provide a resistive force to any motion, harmonic or otherwise, of the seal.

Figure 6:
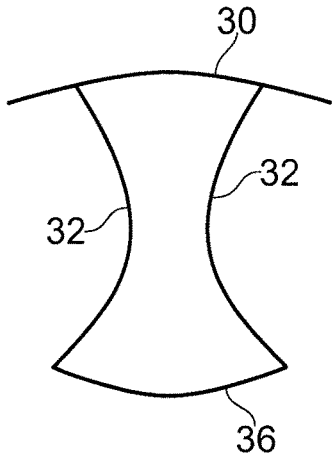
FIG. 6 is a schematic view from the rear of the annulus filler of FIG. 2 under centrifugal loading.

The opposing support walls 32 of each support structure resiliently deform, e.g. flex, to allow outward radial movement of the lid 30 under centrifugal loads. The walls 32 preferably flex inwards towards each other to allow this movement, as shown in FIG. 6 which is a schematic view from the rear of the annulus filler of FIG. 2 under centrifugal loading. The inward flexing tends to produce tensile stress occur on the outside of the walls 32 and compressive stress on the inside. Such flexing is advantageous (compared with, say, outward flexing) because it can promote the formation of an aerodynamic profile of the outer lid 30, and can reduce stresses and flutter in the annulus filler 100. In configurations where there are two or more support structures, it is primarily the rearward support structure that resiliently deforms to allow the outward radial movement of the lid.

Figure 7:
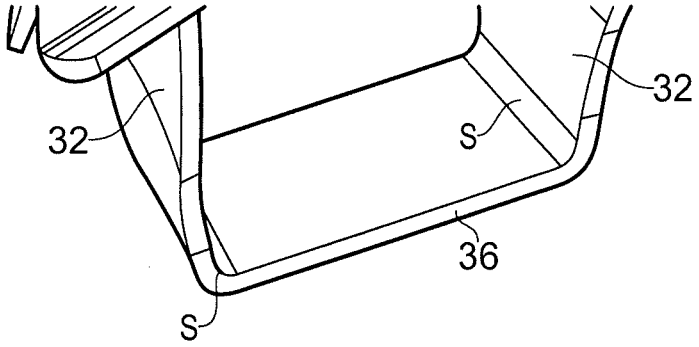
FIG. 7 shows an enlarged perspective view of the rear support structure of the annulus filler of FIG. 2.

However, the centrifugal loading can lead to high stresses on the filler 100, for example in the regions of the support walls neighbouring the attachment strap 36, indicated in FIG. 7 as regions S. In particular, the support walls 32 are placed under a tensile load which tends to open up the radii at the junction of the support walls and the respective attachment strap 36.

Figure 8:
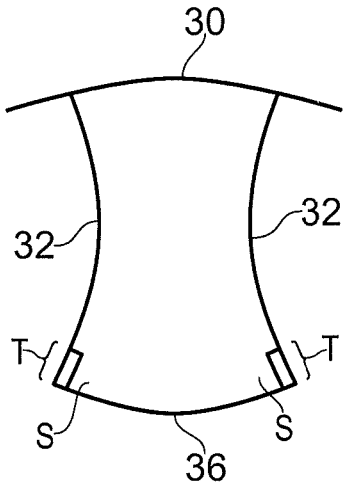
FIG. 8 shows a schematic representation of a rear support structure of another annulus filler under centrifugal loading.
Figure 10:
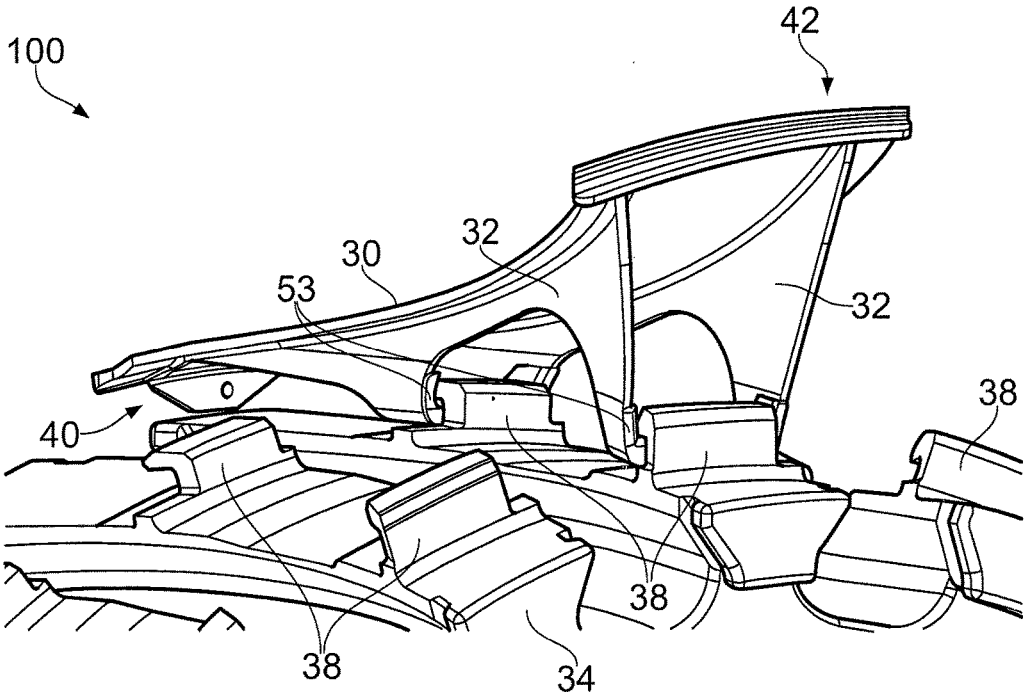
FIG. 10 shows a perspective view from the rear of the annulus filler of FIG. 9 mounted on a rotor disc.
Figure 11:
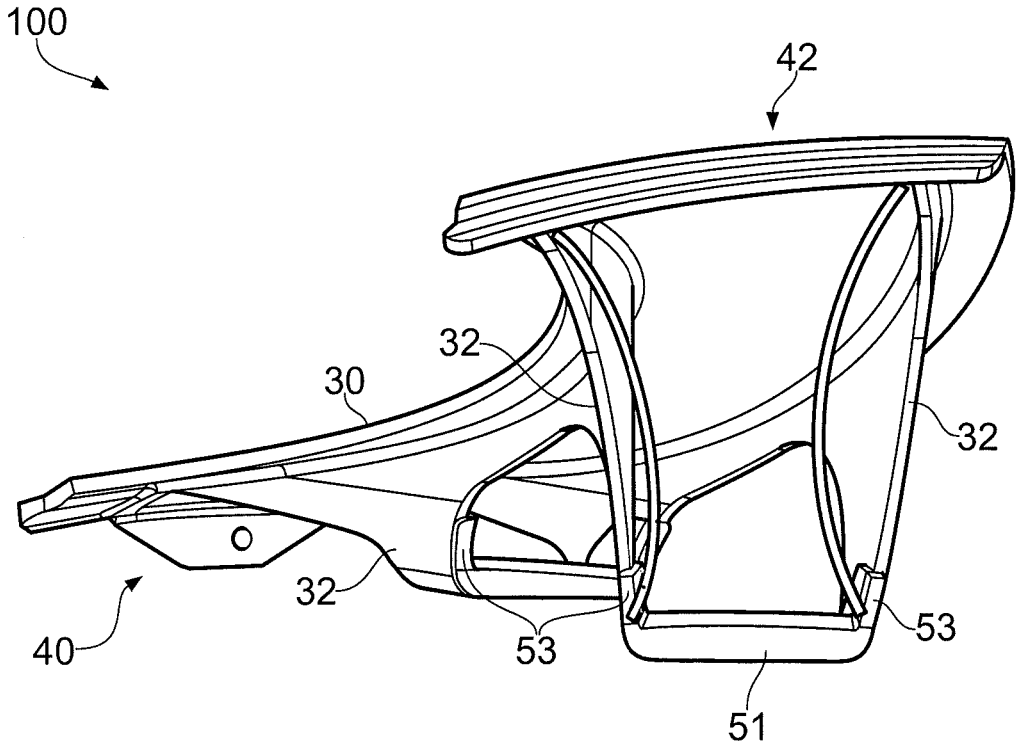
FIG. 11 shows another perspective view from the rear of the annulus filler of FIG. 9.

Therefore, in regions neighbouring the attachment strap 36, each support wall 32 may be thickened, as shown by the region T indicated in FIG. 8. Thickening of the support walls in this region T may reduce the degree of stress incurred at this region. It can also help to prevent the support walls from flexing too much towards each other. FIG. 9 shows a perspective view from the rear of an annulus filler which is similar to the filler of FIG. 2 but has thickened support walls 32 in regions T neighbouring the attachment straps 36. FIG. 10 shows the same view as FIG. 9 but with the annulus filler mounted on a rotor disc 34. FIG. 11 shows another perspective view from the rear of the annulus filler of FIG. 9, but superimposed with bold lines to indicate the exaggerated positions under centrifugal loading of the inwardly flexed side walls 32 of the rear support structure.

Each thickened region T ends at a radial distance from the attachment strap 36 which may be, for example, at least 5%, and/or no more than 40%, of the total radial distance from the attachment strap to the outer lid 30. The support wall 32 may be, for example, at least 20% thicker, and/or may be at most 100% thicker, in the thickened region T than in regions of the support wall radially outside the thickened region. At least in regions neighbouring the support walls 32, the attachment strap 36 may be at least as thick as the thickened regions T of the support walls. In FIGS. 9 to 11, the thickened regions T are formed by wings of a pad structure, as explained in more detail below.

Each attachment strap 36 has a composite material first part 52, and has a second part in the form of a pad 51, shown in FIGS. 12(*a*) and (*b*). As shown in FIG. 13, the composite material first part 52 is integrally formed with the composite material of the support walls 32. The pad 51 is carried by the first part and engages the hook 38 of the rotor disc, as shown in FIG. 10. The pad 51 can be moulded (for example compression moulded, injection moulded or resin transfer moulded), and may be formed from glass fill or injection or compression moulded thermoplastics such as Lytex™, Hex MC™, Torlon™, or pure resin thermoplastics such as polyphenylene sulphide (PPS), polyetheretherketone (PEEK), thermoset epoxy, bis-malemide (BMI). Alternatively the pad 51 may be metallic. The pad 51 can be bonded to the composite material of the support structure by an adhesive, such as epoxy film or paste.

The pad 51 can improve the stress distribution through the load-carrying fibres in the composite from the fan disc hook 38. For example, the pad 51 may be shaped to allow the filler 100 to move and self-centre in use under centrifugal loading, and can be machined to shape prior to fitting, or moulded to shape. It may also be relatively compliant, which can provide better load transfer between the support structure and the hook 38, and can allow the pad 51 to bed in, absorbing small deformations in the attachment strap 36 and/or hook 38. Additionally, the pad 51 may be shaped to protect the load-carrying fibres of the support structure from damage during installation, and may be a galvanic corrosion barrier, preventing or reducing galvanic corrosion between the composite material of the support structure and the material of the rotor disc 34. The pad 51 may also be made from a low friction material, which can negate the need for a dry film lubricant at the support structure-hook interface.

The pad 51 has wings 53 which extend along the support walls 32 to provide the thickening in the thickened regions T of the support walls 32. The pad 51 and its wings 53 may further have wrap-around sides 55 to protect the composite material of the support structure from contact with the fan disc hook 34, and to reduce stress concentrations in the support walls.

As shown in FIG. 13, the composite material first part 52 bridges the support walls 32. However, in a variant configuration shown schematically in FIG. 14, the composite material first part may be formed by two composite material side portions 52*a* which are integrally formed with the composite material of a respective one of the support walls 32, with the pad 51 bridging a gap between the side portions.

The pad 51 may be bonded to the attachment strap 36 and/or the support walls 32 using an adhesive which may be, for example, an epoxy film or epoxy paste adhesive. The pad 51 may be accurately bonded into position using a tooling jig, for example.

Looking now at FIG. 15 and at the support walls 32 of the rear support structure in more detail, each support wall has a concave front edge 59 which extends forwardly and radially outwardly from the front of the attachment strap 36, and each support wall has a concave rear edge 57 which extends rearwardly and radially outwardly from the rear of the attachment strap towards a trailing edge of the lid 30. The rear edge has a first curved section 61 proximal the attachment strap 36, a second curved section 63 proximal the trailing edge, and a substantially straight section 65 therebetween.

The first curved section 61 extends, for example, for at least 5% and/or at most 15%, of the total length of the rear edge 57. The second curved section 63 extends, for example, for at least 10% and/or at most 40%, of the total length of the rear edge 57. The first curved section may have a smaller radius of curvature than that of the second curved section.

The two curved sections 61, 63 allow the trailing edge of the outer lid 30 to move radially outward, increasing the flexibility of the support wall 32, and reducing the mass of the wall while maintaining low stresses in the wall and the attachment strap 36. The straight section 65 reduces stress concentrations in the support wall 32 above the attachment strap 36. If, instead, the rear edge 57 was continuously curved (like the front edge 59), this would also provide a flexible structure but would result in high stresses in the support wall 32 in the region neighbouring the attachment strap 36, particularly along the rear edge 57. Conversely, if the entire rear edge 57 was straight, stresses would be reduced but the wall would be insufficiently flexible.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention.

The invention claimed is:

1. An annulus filler for mounting to a rotor disc of a gas turbine engine and bridging the gap between two adjacent blades attached to the rotor disc, the annulus filler being substantially entirely formed from a polymer matrix composite material, the annulus filler comprising:

an outer lid which defines an airflow surface for air being drawn through the engine in an axial airflow direction; and a support structure which is connectable to the rotor disc to support the outer lid on the rotor disc, the support structure having two support walls extending from opposing lateral sides of the outer lid to an attachment strap for receiving a hook on the rotor disc, the attachment strap bridging the support walls, and, in use under centrifugal loads, the support walls resiliently deforming to allow outward radial movement of the outer lid, wherein:

each support wall is thickened in a region neighbouring the attachment strap; and the hook has laterally spaced side faces and each support wall is arranged to pass around a respective side face such that, when the support structure is connected to the rotor disc, the attachment strap is substantially prevented from sliding tangentially relative to the hook.

2. The annulus filler of claim 1, wherein the thickened region ends at a radial distance from the attachment strap which is no more than 40% of a total radial distance from the attachment strap to the outer lid.

3. The annulus filler of claim 1, wherein the thickened region ends at a radial distance from the attachment strap which is at least 5% of a total radial distance from the attachment strap to the outer lid.

4. The annulus filler of claim 1, wherein each support wall is at least 20% thicker in the thickened region than in regions of the support wall radially outside the thickened region.

5. The annulus filler of claim 1, wherein each support wall is at most 100% thicker in the thickened region than in regions of the support wall radially outside the thickened region.

6. The annulus filler of claim 1, wherein at least in regions neighbouring the support walls, the attachment strap is at least as thick as the thickened regions of the support walls.

7. The annulus filler of claim 1, wherein the attachment strap has a composite material first part which is integrally formed with the composite material of the support walls, and further has a second part in the form of a pad which is carried by the first part and is engageable with the hook of the rotor disc, the pad being formed from a different material to the composite material first part.

8. The annulus filler of claim 7, wherein the pad is a galvanic corrosion barrier to prevent or reduce galvanic corrosion between the composite material of the support structure the rotor disc.

9. The annulus filler of claim 7, wherein the pad has wings which extend along the support walls to provide some or all of the thickening in the thickened regions of the support walls.

10. The annulus filler of claim 7, wherein the composite material first part bridges the support walls.

11. The annulus filler of claim 7, wherein the composite material first part is formed by two composite material side portions, each integrally formed with the composite material of a respective one of the support walls, the pad bridging a gap between the side portions.

12. The annulus filler of claim 1, wherein the support walls of the support structure resiliently deform by flexing inwards towards each other to allow outward radial movement of the outer lid.

13. The annulus filler of claim 1, wherein the polymer matrix composite material is a carbon fibre composite material.

14. The annulus filler of claim 1, for mounting to a fan disc and bridging the gap between two adjacent fan blades attached to the fan disc.

15. The annulus filler of claim 1, having two of the support structures, one supporting a front of the outer lid and another supporting a rear of the outer lid.

16. The annulus filler of claim 1, wherein the support structure supports a rear of the outer lid, and each support wall has a concave rear edge which extends rearwardly and radially outwardly from a rear of the attachment strap towards a trailing edge of the outer lid, each rear edge having a first curved section proximal the attachment strap, a second curved section proximal the trailing edge and a substantially straight section therebetween.

17. A stage for a gas turbine engine comprising:

a rotor disc;

a circumferential row of spaced apart blades attached to the rotor disc; and a plurality of annulus fillers according to claim 1 bridging gaps between adjacent blades.

18. A gas turbine engine having the stage of claim 17.

19. An annulus filler for mounting to a rotor disc of a gas turbine engine and bridging the gap between two adjacent blades attached to the rotor disc, the annulus filler being substantially entirely formed from a polymer matrix composite material, the annulus filler having:

an outer lid which defines an airflow surface for air being drawn through the engine in an axial airflow direction, and a support structure which is connectable to the rotor disc to support the lid on the rotor disc, the support structure having two support walls extending from opposing lateral sides of the lid to an attachment strap for receiving a hook on the rotor disc, the attachment strap bridging the support walls;

wherein the hook has laterally spaced side faces and each support wall is arranged to pass around a respective side face such that, when the support structure is connected to the rotor disc, the attachment strap is substantially prevented from sliding tangentially relative to the hook.

20. The annulus filler of claim 19, wherein the attachment strap has a composite material first part which is integrally formed with the composite material of the support walls, and further has a second part in the form of a pad which is carried by the first part and is engageable with the hook of the rotor disc, the pad being formed from a different material to the composite material first part.

21. The annulus filler of claim 20, wherein the pad is a galvanic corrosion barrier to prevent or reduce galvanic corrosion between the composite material of the support structure the rotor disc.

22. The annulus filler of claim 20, wherein the pad has wings which extend along the support walls to provide some or all of the thickening in the thickened regions of the support walls.

23. The annulus filler of claim 20, wherein the composite material first part bridges the support walls.

24. The annulus filler of claim 20, wherein the composite material first part is formed by two composite material side portions, each integrally formed with the composite material of a respective one of the support walls, the pad bridging a gap between the side portions.

25. The annulus filler of claim 19, wherein the support walls of the support structure resiliently deform by flexing inwards towards each other to allow outward radial movement of the outer lid.

* * * * *